US006464463B2

(12) United States Patent
Yvon Goga et al.

(10) Patent No.: US 6,464,463 B2
(45) Date of Patent: Oct. 15, 2002

(54) BLADE LOCKING DEVICE WITH HAMMER FASTENER ON A DISK

(75) Inventors: Jean-Luc Christian Yvon Goga, Champagne sur Seine (FR); Jacky Naudet, Bondoufle (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 09/880,764

(22) Filed: Jun. 15, 2001

(65) Prior Publication Data

US 2001/0055527 A1 Dec. 27, 2001

(30) Foreign Application Priority Data

Jun. 15, 2000 (FR) ..... 00 07610

(51) Int. Cl.[7] ..... F01D 5/30
(52) U.S. Cl. ..... 416/215; 416/220 R
(58) Field of Search ..... 416/220 R, 221, 416/215

(56) References Cited

U.S. PATENT DOCUMENTS 2,315,631 A 4/1943 Lloyd et al. ..... 416/216
3,088,708 A 5/1963 Feinberg ..... 416/215
3,216,700 A 11/1965 Bostock, Jr. ..... 416/216

FOREIGN PATENT DOCUMENTS

| | | |
|---|---|---|
| DE | 2237348 | 1/1974 |
| GB | 659592 | 10/1951 |
| GB | 2156908 | 10/1985 |

*Primary Examiner*—Edward K. Look
*Assistant Examiner*—Dwayne J. White
(74) *Attorney, Agent, or Firm*—Bacon & Thomas, PLLC

(57) ABSTRACT

The invention relates to hammer-fastener blade-locking device affixing the blades in the channel (2) of a turbojet-engine rotor disk (1) and comprising a case (15) of which the cross-section matches that of the channel (2), further a locking element (16) mounted in radially displaceable manner in a traverse orifice in the case (15) and receivable in part in a lock housing (9*a*, 9*b*), and a drive bolt (17) acting on the locking element (16). The locking element (16) comprises stops (32*a*) sliding in windows (22*a*) of the case (15). The bolthead (4) is large and is radially affixed between the bottom of the channel (2) and the base (20) of the case (15).

4 Claims, 4 Drawing Sheets

BLADE LOCKING DEVICE WITH HAMMER FASTENER ON A DISK

BACKGROUND OF THE INVENTION

The invention relates to a device having locking blades disposed in the peripheral channel of a turbojet-engine disk, the blades include roots of a hammer attachment type which are insertable through a window into the channel and are kept therein by geometrically interlocking with the channel's sidewalls. The locking device is inserted through the loading window into the channel and includes a locking element which can be positioned into a lock housing in sidewalls of the channel by means of a radial drive bolt of which the head rests against the bottom of the channel.

Several locking elements per stage may be used. In general the bolthead, which is wider than the shank, is housed in a depression in the channel bottom opposite the corresponding lock housing. Because the bolthead is wider than the shank, the bolt is always retained. In present-day designs, the locking element consists of a salient on the upper side of a case which, in a locked position, rests against the channel sidewalls near the throat of the channel. This case comprises a lower base which is positioned away from the bolthead in order to allow the case to slide inside the channel when the blades are being assembled. In order to achieve sliding, the salient on the case must be situated inside the channel, and the base of the case should rest against the bolthead and be situated near the bottom of the channel.

When the device is situated opposite the lock housing, as a result of the rotation of the blade assembly about the disk, the case rises outward on account of the drive bolt being operatively moved by a wrench. The salient is kept in the lock housing by being braced on one hand between the latch case resting in the disk throat and on the other hand the bolthead housed in a depression at the channel bottom. The system operates in bolt/nut manner and is slowed either by local deformation, a projecting thread or any other means.

If the bracing effect should be lost, only the self-locking feature retains the bolt and prevents the salient from escaping from the lock housing.

By its intrinsic design, the integral unit consisting of the case and its salient is devoid of constraining guide elements when it slides in the channel during assembly. Accordingly, the bolthead might become improperly positioned in its depression during the tightening phase and as a consequence, the bolthead subsequently might move during turbojet-engine operation and the bracing effect might be lost. Tightening a poorly positioned bolt also may entail jamming the thread and keep the salient in the lock housing, ultimately causing difficulties in disassembling the device for maintenance work.

Moreover, when the turbojet engine is operational, the bolt is subjected to substantial centrifugal forces which, if the bracing effect were lost, may rotate this bolt which may enter the gas stream, and in the long run, the salient might then be released from the lock housing when the turbojet engine is stopped.

SUMMARY OF THE INVENTION

The objective of the invention is a locking device which in the operational mode of the turbojet engine, retains locking blades within the channel, and which prevents seizing during assembly.

The invention attains this goal in that the locking element is mounted in an axially sliding manner in a radial aperture of a case of which the cross-section matches that of the channel. The bolthead is trapped between the channel bottom and the case base.

Accordingly, when sliding in the channel, the case is constrained by being guided, and as a result, the bolt axis reliably is held in an axial direction. Moreover the bolthead is radially stationary relative to the case and the effect of the centrifugal forces on the locking element, in the event of partial bolt loosening, prevents this bolt from rotating because the bolthead is constrained by resting against the case base.

More specifically, the device proposed by the invention is characterized in that it comprises a case positioned between the roots of a pair of blades and has a cross-section matching that of the channel. The case includes a lower base situated above the channel bottom and a cross-sectionally non-circular, radial, traverse aperture. The locking element is adapted to slide within the aperture when acted on by the drive bolt. The bolthead dimensions are such that it shall remain trapped between the channel bottom and the case base.

Preferably the device also includes means restricting the rise of the locking element.

The means limiting the rise of the locking element are fitted with cooperating stop surfaces matching the locking element and the case.

Advantageously the locking element may be retracted into the case. This feature assures that the device may slide inside the channel during assembly.

Other advantages and features of the invention are elucidated in the following, illustrative and non-limiting description and in relation to the attached drawings.

DETAILED DESCRIPTION OF THE INVENTION

Figure 3:
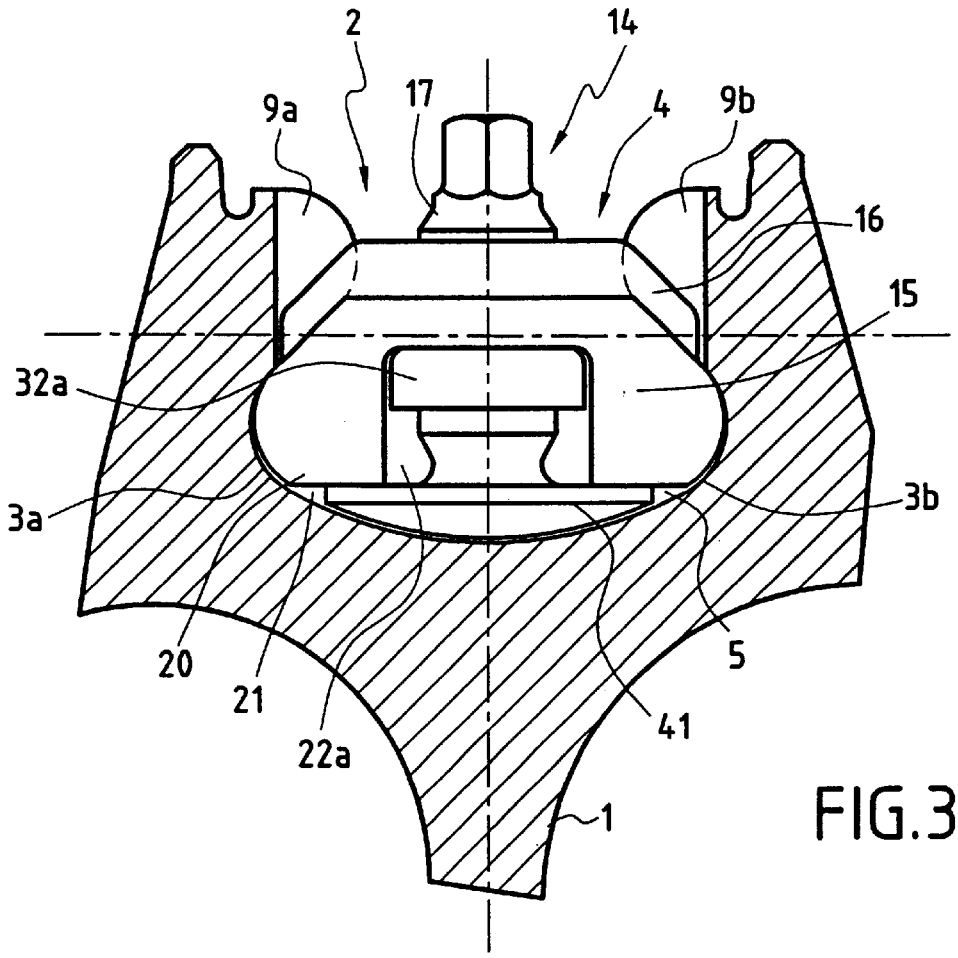
FIG. 3 is a section along line III—III of FIG. 2 in a radial plane passing through the axis of the turbojet engine, the blades being omitted from this Figure for the sake of clarity.

FIG. 3 is a section of a turbojet-engine rotor disk 1 which is fitted at its periphery with a channel 2 designed to keep in place the blade roots of a hammer-fastener type. This channel 2 is bounded by cross-sectionally curved sidewalls 3*a* and 3*b* and opens outward through a throat 4 of which the dimension in the direction of the rotor axis of rotation is less than the dimension of the cavity 5 subtended in the bottom of the channel 2. The blade root cross-section in the radial plane through the axis of rotation of the disk 1 is matched to the cross-section of the channel 2 in order to keep such blade roots affixed in geometrically interlocking manner.

Figure 1:
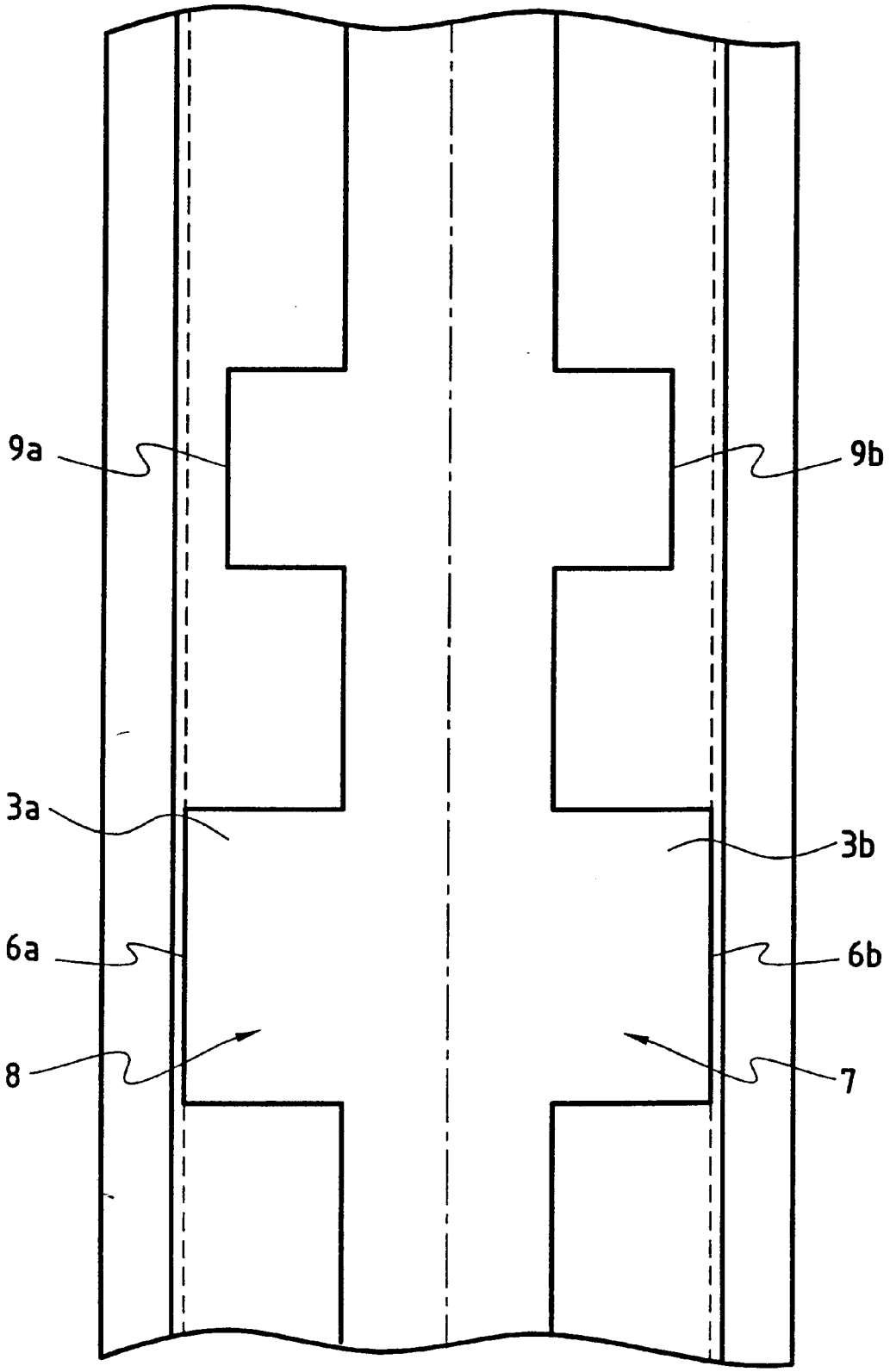
FIG. 1 is a top plan view of a portion of a rotor disk devoid of blades.

FIG. 1 is a top view of a portion of the disk 1. As shown by FIG. 1, the sidewalls 3*a* and 3*b* comprise a first pair of mutually opposite cutouts 6*a* and 6*b* constituting a loading window to allow inserting the roots 7 of the blades 8 into the channel 2 when the blades 8 are being assembled, and a second pair of radial cutouts 9*a*, 9*b* constituting the housing for a blade locking device which is the object of the present invention. The second pair of cutouts 9*a*, 9*b* is angularly offset from the first pair of cutouts 6*a*, 6*b* by an amount which equals the angle subtended by two consecutive blades or a multiple of said angle. It should be noted that the same rotor disk 1 may be fitted with several locking devices of the invention.

Figure 2:
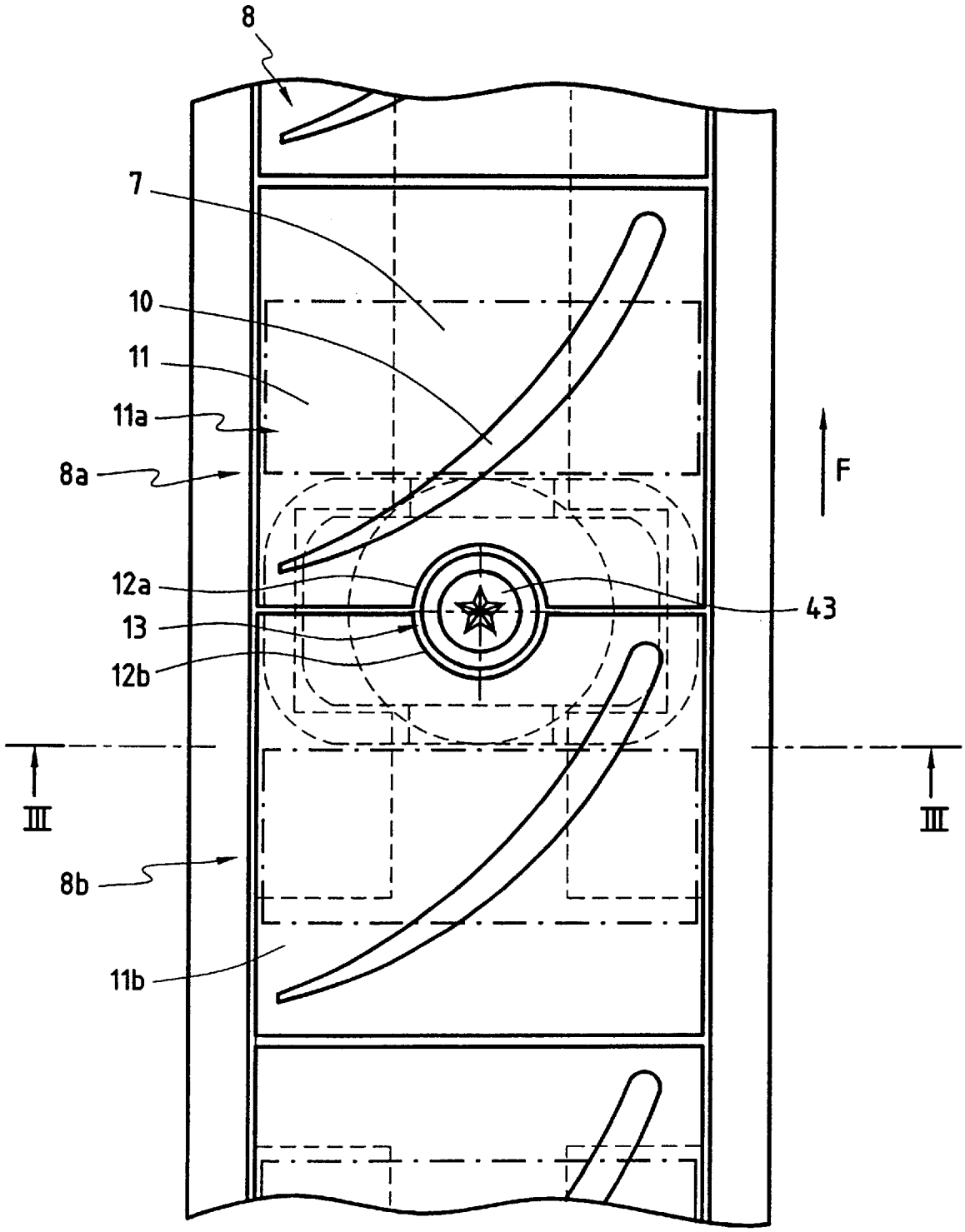
FIG. 2 is a top plan view of a portion of a rotor disk fitted with blades which each comprise a hammer fastener and which are affixed by a locking device of the invention.

FIG. 2 shows the same portion of the disk 1 when fitted with its blades 8. Between its root 7 and its airfoil 10, each blade 8 comprises a platform 11 covering the periphery of the disk 1, the set of platforms 11 of the blades 8 internally bounding the passage of the gas flows.

The blades 8 are mounted on the disk 1 in the same manner. The root 7 of each blade 8 is consecutively inserted through the window formed by the first pair of cutouts 6*a*, 6*b* into the channel 2 and then the blade 8 is made to slide in the direction of the arrow F until its platform 11 comes to a stop against the previously inserted blade.

All blades 8 are identical except for the second-last blade to be assembled, which is referenced by 8*a*, and the last one, which is referenced by 8*b*, which are fitted at the edges adjacent to their platforms 11*a* and 11*b* with notches 12*a* and 12*b* constituting an orifice 13 of which the function will be elucidated further below.

Figure 4:
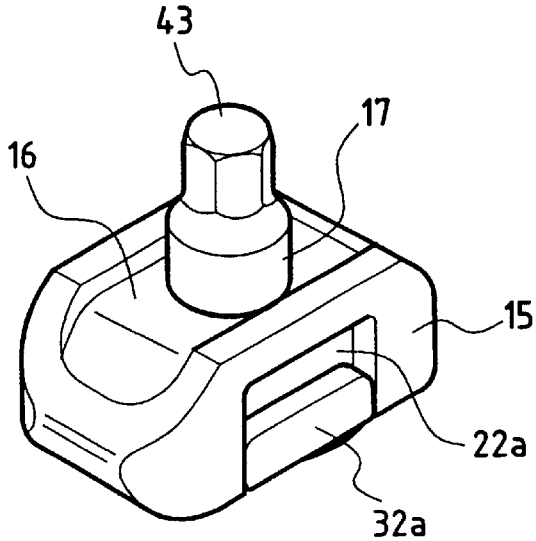
FIG. 4 is a perspective view of the locking device of the invention.

Following insertion of the second-last blade 8*a* into the channel 2, the locking device 14 shown in perspective in FIG. 4 will be inserted through the loading window into the channel 2, and then the root 7 of the last blade 8*b* is moved into the loading window between the last assembled blade 8*a* and the first assembled blade, whereupon the set of all blades 8 is made to slide in the direction of the arrow F by an angle corresponding to half the angle between two consecutive blades. The platforms 11*a* and 11*b* of the first assembled blade and the last assembled blade 8*b* join in the median plane of the loading window constituted by the first pair of cutouts 6*a* and 6*b*. In this position, the locking device 14 is configured between the roots 7 of the blades 6*a* and 6*b* and is located opposite the second pair of cutouts 9*a* and 9*b*.

The axial and peripheral dimensions of the cutouts 9*a* and 9*b* are less than those of the cutouts 6*a* and 6*b* of the loading window for the blades 8 in order to prevent the blades 8 from escaping when moving in front of these cutouts 9*a* and 9*b*.

Figure 5:
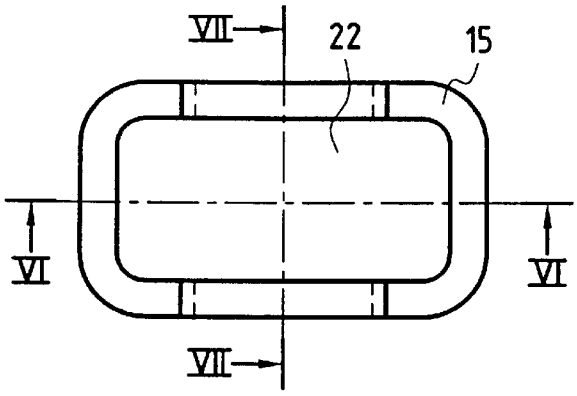
FIG. 5 is a top plan view of the case of the locking device.
Figure 8:
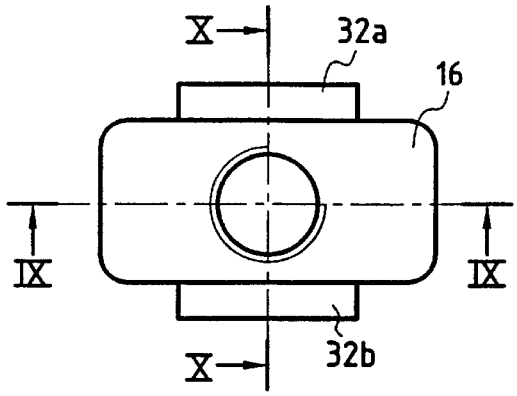
FIG. 8 is a top plan view of the locking element.
Figure 6:
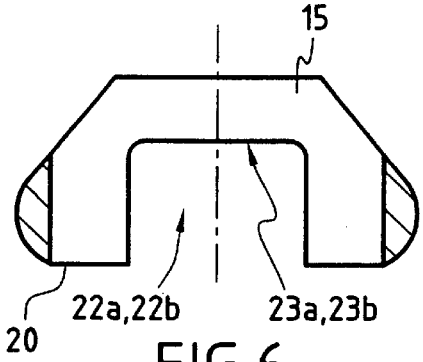
FIG. 6 is a section along line VI—VI of FIG. 5 of the locking-device case.
Figure 9:
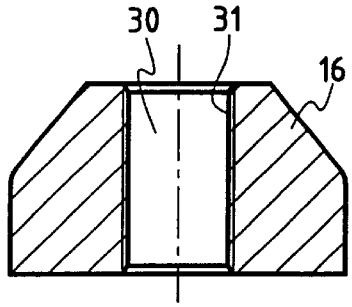
FIG. 9 is a section along line IX—IX of FIG. 8 of the locking element.
Figure 7:
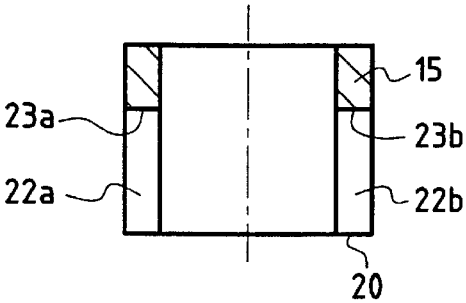
FIG. 7 is a section along line VII—VII of FIG. 5 of the locking-device case.
Figure 10:
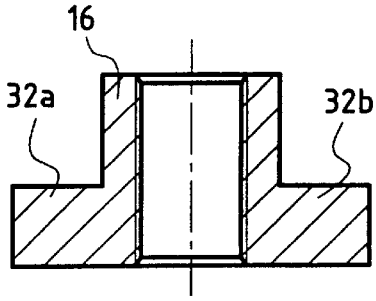
FIG. 10 is a section along line X—X of FIG. 8 of the locking element.
Figure 11:
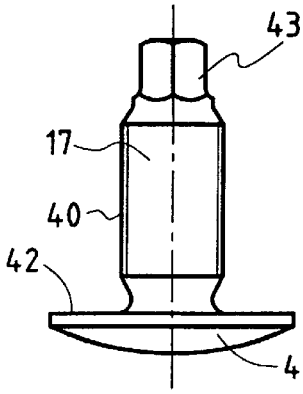
FIG. 11 is a side elevation view of the drive bolt.

As shown in FIGS. 3 and 4, the locking device 14 consists of three parts, namely a case 15 shown in detail in FIGS. 5 through 7, a locking element 16 shown in detail in FIGS. 8 through 10, and a drive bolt 17 shown in FIG. 11.

The cross-section of the case 15 in a radial plane through the axis of rotation of the disk 1 is substantially equal to that of a root 7 of a blade 8, unless this case 15 comprise a lower base 20 configured near the bottom of the channel 2 and together with this bottom defines a space 21 large enough to house the head of the bolt 17 on order that said bolt be practically radially affixed in place relative to the case 15 in the manner comprehensively discussed further below. In this manner, the case 15 is retained in the channel 2 by being geometrically caught within the sidewalls 3*a* and 3*b* of the channel 2. The case 15 is fitted with a non-circular radial, traverse orifice 22, generally rectangular cross-section, wherein slides the locking element 16.

The walls of the case 15 are opposite the roots 7 of the adjacent blades 8*a* and 8*b* and comprise each a window, respectfully 22*a* and 22*b*, which is open at the side of the base 20 and of which the upper walls limit the vertical excursion of the locking element 20 in the radial, traverse orifice 22.

The cross-section of the locking element 16 is substantially the same as that of the orifice 22. Its height is substantially equal to the height of the case 15 and preferably its height shall be slightly less than that of this case 15 in order that, in the lowered position shown on FIG. 4, the locking element 16 can be totally retracted into the radial orifice 22 of the case 15. This lowered position corresponds to the assembly/disassembly position of the blades 8. Moreover the locking element 16 is fitted with a radial tap 30 fitted with a thread 31 cooperating with the thread of the shank 40 of the drive bolt 17. The locking element 16 comprises sides which are opposite the windows 22*a* and 22*b* of the case 15 and which are fitted with lateral stops 32*a* and 32*b* which respectively slide into the windows 22*a* and 22*b*. When, as shown in FIG. 3, the upper surfaces of the stops 32*a* and 32*b* rest against the upper walls 23*a* and 23*b* of the windows 22*a* and 22*b*, the upper portion of the locking element 16 will project above the case 15 and be partly housed in the second cutouts 9*a* and 9*b*. In this position, the case 15 is affixed in the channel 2 and as a result the set of blades 8 are locked.

The drive bolt 17 comprises a large bolt head 41 received in space 21 subtended by the base 20 of the case 15 and the bottom of the channel 2. The diameter of this head 41 is such that the head's upper surface 42 may come to rest against the base 20 of the case 15. The end 43 of the drive screw 17 is located away from the bolthead 41 and is received in the orifice 13 constituted by the notches 12*a* and 12*b* of the platforms 11*a* and 11*b*. End 43 is fitted with means cooperating with a tightening wrench, a hexagonal wrench or illustratively an Allen wrench.

At the very beginning, the drive bolt is screwed onto the locking element 16 and then the locking element 14 is placed into the channel 2.

Next, the assembly is mounted in the radial, traverse orifice 22 of the case 15 in such a way that the base 20 rests against the upper surface 42 of the bolthead 41 so that the locking element 16 is entirely received by the orifice 22. By retaining the drive bolt 17 at its end 43, the locking device 14 can be placed in the channel 2 through the loading window of the blades 8.

When all the blades 8 have been assembled and the unit is made to slide so that the locking device 14 is located opposite the cutouts 9*a* and 9*b*, the drive bolt 17 is rotated by a screwing tool 16 cooperating with the end 43 for the purpose of partly raising the locking element 16 in the lock housing constituted by the cutouts 9*a* and 9*b*. The locking element 16 is raised until the upper sides of the stops 32*a* and 32*b* of the locking element 16 rest against the upper sides 23*a* and 23*b* of the windows 22*a* and 22*b* of the case 15. In this final position, the bolthead rests against the bottom of the channel 2 and the case 15 rests against the sidewalls 3*a* and 3*b* of the channel 2.

If by accident the bolt should rotate slightly in the other direction during turbojet-engine operation, the initially created bracing effect vanishes thereby, the supports between the stops 32*a*, 32*b* of the locking element 16 and the upper surfaces 23*a*, 23*b* of the windows 22*a*, 22*b* of the case 15 are lost. However, in such an event, the mass of the locking element 16, which is subjected in operation to centrifugal forces, will load the drive bolt 17, and the upper surface 42 of the bolt head 41 will come to rest against the base 20 of the case 15 at a substantial distance from the axis of the drive bolt 17, whereby further rotation of the drive bolt 17 will have been counteracted.

In order for the locking element 16 to leave the lock housing, a substantial bolt rotation is required to drive the locking element inside the radial, traverse orifice 22 while being intrinsically repulsed outward by the centrifugal forces.

Inversely, excessive bracing entails a large stress underneath the bolt head, tending to loosen the bolt in the centrifugal field.

As a result and according to the invention, either the bolt 17 if slightly loosened will be loaded by the locking element 16, or, if the initial bracing is excessive, the bolt will be made less tight, all of this due to the centrifugal forces.

In this manner the invention provides reliable locking of the blades 8 onto the disk 1.

We claim:

1. A device for locking blades in a peripheral channel of a turbojet engine disk, said blades having roots adapted to engage side walls of said channel, said channel including a loading window for inserting said blade roots and a lock housing disposed along thereof, said locking device restraining said blades against movement from said channel, said locking device comprising:

a case adapted to cooperate with said channel, said case forming a lower base dimensioned to slidably engage with said channel, and a radial, transverse aperture having a non-circular cross-section;

a locking element forming an axial, threaded hole, said locking element configured to slidably engage within said aperture;

a radial drive bolt threadably engaged in said threaded hole, said drive bolt forming a bolt head that is positioned between a bottom surface of said lower base and said channel;

wherein said drive bolt is operable to cause said locking element to forcibly engage side walls of said lock housing, said locking element in cooperative engagement with said lock housing to prevent movement of said blades in said channel.

2. The device as claimed in claim 1 wherein said locking element forms two stops located along a bottom portion on oppositely opposed sides.

3. The device as claimed in claim 2 wherein said stop surfaces of said locking element cooperatively engage with two stop surfaces of said case to restrict motion of said locking element.

4. The device as claimed in claim 1 wherein said locking element is arranged to retract into said case.

* * * * *